US005644872A

United States Patent [19]

Perdue

[11] Patent Number: 5,644,872

[45] Date of Patent: Jul. 8, 1997

[54] SOUND ABSORBING PANEL

[76] Inventor: Jay Perdue, Rte. 6 Box 105, Amarillo, Tex. 79124

[21] Appl. No.: 398,868

[22] Filed: Mar. 6, 1995

[51] Int. Cl.[6] ..... E04B 1/82

[52] U.S. Cl. ..... 52/144; 52/791.1; 181/284; 181/291; 428/193

[58] Field of Search ..... 52/144, 145, 406.2, 52/791.1, 309.3, 309.15; 181/284, 286, 290, 291; 428/192, 193, 194

[56] References Cited

U.S. PATENT DOCUMENTS

| | | | |
|---|---|---|---|
| 2,742,385 | 4/1956 | Bovenkerk | 52/406.2 X |
| 2,802,764 | 8/1957 | Slayter et al. | 181/291 |
| 3,037,578 | 6/1962 | Jack | 181/291 |
| 3,183,996 | 5/1965 | Capaul | 181/291 |
| 3,422,920 | 1/1969 | Greason et al. | 181/291 |
| 3,748,799 | 7/1973 | Tough et al. | 52/144 |
| 3,971,867 | 7/1976 | Randall | 52/145 X |
| 4,083,159 | 4/1978 | Hatch et al. | 52/309.3 X |
| 4,146,999 | 4/1979 | Petronz et al. | 181/291 X |
| 4,271,649 | 6/1981 | Belanger | 52/309.15 X |
| 4,287,263 | 9/1981 | Woodring et al. | 181/290 |
| 4,574,099 | 3/1986 | Nixon | 181/291 X |
| 4,594,278 | 6/1986 | Nixon | 181/291 X |
| 4,610,119 | 9/1986 | Bench, Sr. | 52/309.3 |
| 4,611,445 | 9/1986 | Pressley | 52/144 |
| 5,009,043 | 4/1991 | Kurrasch | 52/144 X |
| 5,020,632 | 6/1991 | Nelson | 181/290 |
| 5,056,279 | 10/1991 | Veldhoen | 52/144 |
| 5,115,616 | 5/1992 | Nixon | 52/144 |
| 5,129,202 | 7/1992 | Payne et al. | 52/144 X |
| 5,135,073 | 8/1992 | Nelson | 181/290 |
| 5,174,086 | 12/1992 | Payne et al. | 52/144 X |

FOREIGN PATENT DOCUMENTS

| | | | |
|---|---|---|---|
| 2704051 | 10/1994 | France | 52/144 |
| 404281980 | 10/1992 | Japan | 52/144 |
| 92021836 | 12/1992 | WIPO | 52/144 |

*Primary Examiner*—Carl D. Friedman
*Assistant Examiner*—Yvonne Horton-Richardson
*Attorney, Agent, or Firm*—Norman B. Rainer

[57] ABSTRACT

A self-supporting sound-absorbing panel intended to be attached to indoor walls and ceilings of buildings includes a core assembly made from a mat of rockwool having four straight perimeter edges disposed in a rectangular array, and sheets of non-woven interadhered fiberglass bonded to front and rear surfaces of the mat. A rigid rectangular frame surrounds and secures the core assembly. A cloth facing is tautly disposed upon the front surface of the panel, extends around the edges of the frame, and is bonded to the rear of the panel.

6 Claims, 1 Drawing Sheet

SOUND ABSORBING PANEL

BACKGROUND OF THE INVENTION

1. Field of the Invention

This invention concerns self-supporting sound-absorbing panels intended to be attached to indoor walls and ceilings of buildings.

2. Description of the Prior Art

It is often sought to diminish the noise level in indoor rooms, auditoriums, gymnasiums, restaurants, hallways, manufacturing plants and other indoor areas. Various types of sound-absorbing rigid panel products have been employed as ceiling tiles, and various rigid and soft wall coverings have been disclosed for sound absorption.

In general, prior sound-absorbing materials have either been difficult to install or have been deficient with respect to fireproof characteristics. Panels have been fabricated of fiberglass batting for application to indoor room surfaces. Although fiberglass panels provide good thermal insulation, their acoustic absorption characteristics and aesthetic appearance are generally poor. Such panels are also easily susceptible to physical damage as a result of abrasion or impact, as by a ball.

Products made of "rockwool", sometimes called "mineral wool," have been employed in the building industry in the form of loose batting used for thermal insulation. Rockwool is generally produced by the centrifugal spinning of molten mineral magna. The resultant fibers, unlike fiberglass fibers, are of indeterminate length, and are intermingled as a loose batting resulting from their manner of production.

Batting products, whether of fiberglass or rockwool can have various bulk densities, depending upon the degree of compaction of the fibers, the specific gravity of the fibers, and the amount of binder which may be employed to impart dimensional stability to the structure. When the batting is formed into a shape-retaining self-supporting structure, that structure is often referred to as a mat or panel.

It is accordingly an object of the present invention to provide a panel product that can be applied to flat indoor surfaces to achieve sound absorption.

It is a further object of this invention to provide a self-supporting panel as in the foregoing object having a rectangular configuration which enables a multitude of the panels to be placed in abutting relationship to cover a wall surface.

It is another object of the present invention to provide a panel of the aforesaid nature improved with respect to aesthetic appearance, resistance to physical damage and fire-resistance.

It is a still further object of this invention to provide a panel of the aforesaid nature of simple construction amenable to low cost manufacture.

These and other beneficial objects and advantages will be apparent from the following description.

SUMMARY OF THE INVENTION

The above and other beneficial objects and advantages are accomplished in accordance with the present invention by a core assembly and panel produced therefrom, said core assembly comprising:

a) a mat of rockwool bounded by flat front and rear surfaces and four straight perimeter edges disposed in a rectangular array, said mat having a density between 6 and 8 pounds per cubic foot (lbs./cu.ft.) and a thickness between one and two inches, and b) a sheet of non-woven interadhered fiberglass bonded to each flat surface of said rockwool mat, said sheet having a thickness between 20 and 30 mils.

Said panel is produced from said core assembly, and further comprises:

c) a rigid rectangular frame comprised of four identical elongated straight sections, each section comprised of paired spaced apart parallel sidewalls disposed to lie against the flat surfaces of said rockwool mat, and an end wall disposed orthogonally to said sidewalls as a continuous integral extension thereof and forming with said sidewalls a structure of uniform U-shaped trough-like cross sectional configuration, said end wall disposed to lie against an edge of said rockwool mat, and d) a cloth facing tautly disposed upon the front surface of said core assembly and extending around said perimeter edges and onto said rear surface where said facing is bonded to said frame.

In a preferred embodiment, the sidewalls of the sections of said frame are disposed to lie between a flat surface of the rockwool mat and the corresponding fiberglass sheet which is bonded to said sidewall.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
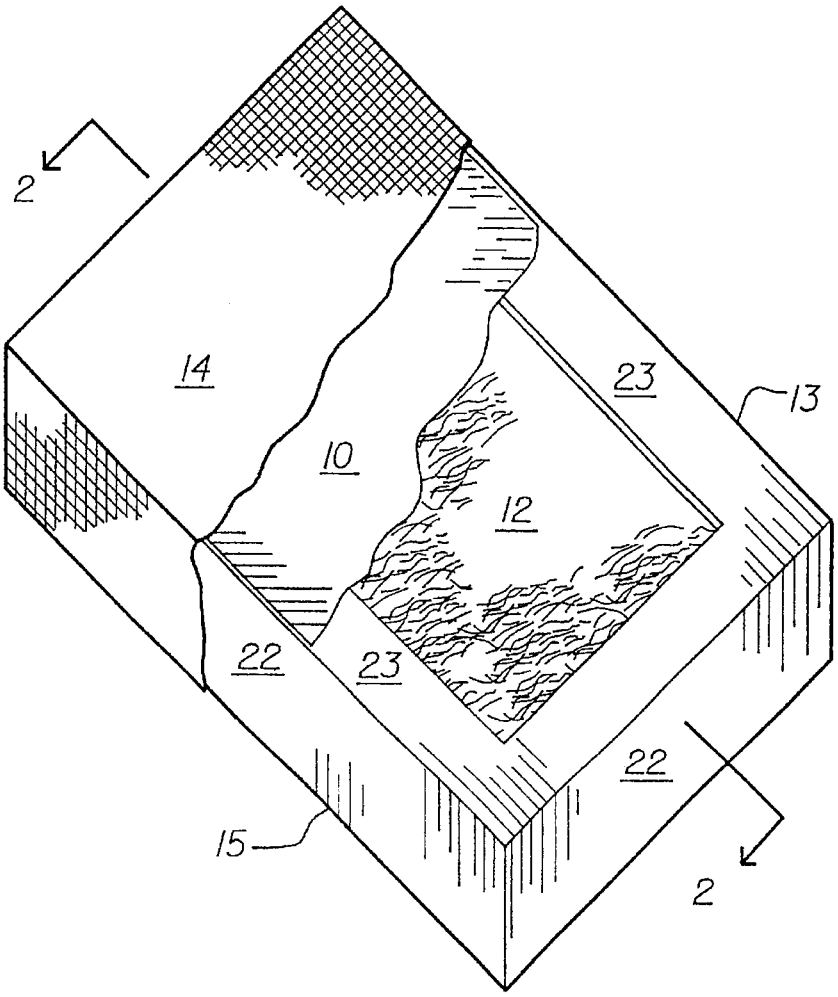
FIG. 1 is a top perspective view of an embodiment of the panel of this invention with portions broken away to reveal interior details.
Figure 2:
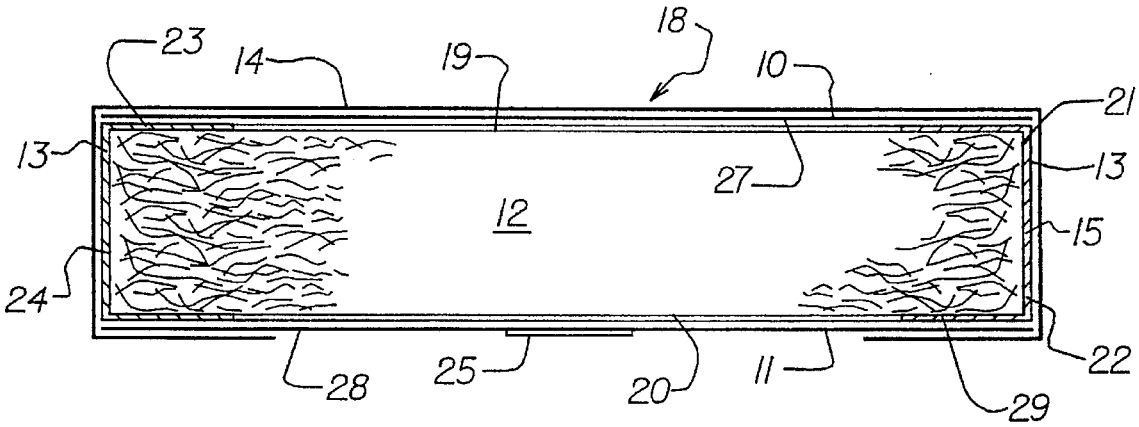
FIG. 2 is a sectional view taken in the direction of the arrows upon the line 2—2 of FIG. 1.

Referring to FIGS. 1 and 2, an embodiment of the core assembly 18 of the present invention is shown in combination with frame 13 and cloth facing 14 to produce the sound-absorbing panel of this invention.

Said core assembly is comprised of a mat of rockwool 12 bounded by flat front and rear surfaces 19 and 20, respectively, and four straight perimeter edges 21 disposed in a rectangular array. Said mat has a density between 6 and 8 pounds per cubic foot and a thickness between one and two inches. It has been found that, at densities below 6 lbs./cu. ft., the mat has insufficient rigidity to be useful in the panel of this invention. At densities greater than 8 lbs./cu.ft., the mat provides insufficient sound absorption in the panel of this invention. The thickness of the rockwool mat should be at least 1 inch in order to provide adequate sound absorption. Thickness greater than two inches do not afford significant further sound absorption, and have been found to cause bulging in the center of large panels.

Front and rear sheets 10 and 11, respectively, fabricated of non-woven interbonded fiberglass are bonded to the front and rear surfaces, respectively, of mat 12. Said sheets are preferably identical, having a thickness between 20 and 30 mils and having smooth interior and exterior surfaces 27 and 28, respectively. The sheets are preferably made from continuous length borosilicate glass fibers laid in a swirl pattern and interadhered with a bonding agent such as a urea-formaldehyde resin. The bonding agent may typically comprise between about 14% and 22% of the total weight of the fiberglass sheet. The fiberglass sheets are consequently of high strength and uniform texture. The individual glass fibers have a diameter between 0.0001 and 0.001 inch, a tensile strength of about 500,000 p.s.i., and elongation to break of about 4.8%. The fiberglass sheet may have a weight in the range of 0.75 to 3 ounces/square foot.

The fiberglass sheets enhance the stability and durability of the intervening rockwool mat. Furthermore, because of the critically selected characteristics of the fiberglass sheets, in conjunction with specialized aspects of panel construction, the fiberglass sheets do not adversely affect the sound-absorbing characteristics of the panel. In fact, the fiberglass has been found to enhance sound absorption in certain sound frequency ranges. Bonding agents secure the fiberglass mats to both the flat surfaces of rockwool mat, forming a sandwich core assembly. The rockwool mat and fiberglass sheets are of identical rectangular perimeter, and are aligned so as to provide a rectangular core perimeter 15.

The panel of the present invention is derived from the core assembly described herein above. Frame 13 is disposed about core perimeter 15. Said frame is comprised of four identical elongated straight sections 22. Each section 22 is further comprised of paired spaced apart front and rear sidewalls 23 and 29, respectively, disposed to lie against the flat surfaces of mat 12, and an end wall 24 disposed orthogonally to said sidewalls as a continuous integral extension thereof. Sections 22 accordingly have a uniform U-shaped trough-like cross sectional configuration. End wall 24 is disposed to lie against an edge 21 of mat 12. The four sections 22 are preferably emplaced with the aid of bonding agents. Frame 13 may be of metal or plastic construction, and facilitates the interabutment of adjacent panels in producing a continuous wall structure.

It is to be noted that, in the exemplified preferred embodiment, sidewalls 23 of frame sections 22 are emplaced between a flat surface of mat 12 and the corresponding fiberglass sheet. Bonding material is preferably applied between the sidewall and the fiberglass sheet. By virtue of this method of construction it has been found that greater overall structural integrity is imparted to the panel. Also, any lines of demarkation between the frame and interior region of the panel will be obscured, thereby presenting a smoother appearance.

Cloth facing 14 is fabricated of fiberglass or other synthetic, preferably non-flammable fibers. Said facing is tautly disposed upon front sheet 10 of the core assembly, and extends around said perimeter edges and onto rear sheet 11 where the cloth is attached to the frame.

Means may be associated with the rear of the panel for attachment to a wall surface. Such attachment means may be in the form of a releasible securing structure 25. Suitable securing structures include clips, tooth plate, hooks, loops or hook and loop fastener material commercially available under the trademark VELCRO from the Velcro Corporation of N.Y. The panel may alternatively be bonded to a wall surface by way of an adhesive composition applied to exterior surface 28 of sheet 11.

The panel of the present invention will pass the fire test prescribed by ASTM-84–89 Class A, providing a flame spread reading of 20 and smoke developed reading of 115.

The panel has a compressive resistance of between 200 and 300 lbs./ft.$^2$ at 10% compression. Accordingly, when the panel of this invention is impacted, as by a ball, there is 95% immediate recovery from deformation. The remaining 5% recovery is slowly achieved.

When tested for sound absorption by way of ASTM C423-90a test, the panel of this invention provides values above 0.85. The dimensions of the panel may range from about 2'×2'to 4'×8'.

A further understanding of my invention will be had from a consideration of the following example which illustrates a preferred embodiment. It is understood that the instant invention is not to be construed as being limited by said example or by the details therein.

EXAMPLE 1

A panel of this invention was made by gluing two fiberglass sheets to the opposed flat surfaces of a rockwool mat, producing a sandwich core assembly. The glue employed is an organic solvent solution of a tacky polymer. The fiberglass sheets are 30 mil thick. The rockwool mat is 1"thick and has a density of 8 lbs./cu. ft. The mat and sheets are of identical 2'×4'configuration. A plastic frame is disposed around the perimeter of the core assembly. A polypropylene fabric of 11.7 ounces/sq. yd., is tightly drawn over the front fiberglass sheet and glued to the frame upon the rear face of the panel. The panel is subjected to ASTM C423-9a test. The following data was obtained.

| Frequency | Sound Absorption[m$^2$] | Sound Absorption Coeff. |
|---|---|---|
| 125 | 1.66 + 0.72 | 0.28 + 0.12 |
| 250 | 3.97 + 0.22 | 0.67 + 0.04 |
| 500 | 6.60 + 0.10 | 1.11 + 0.02 |
| 1000 | 6.25 + 0.07 | 1.05 + 0.01 |
| 2000 | 5.81 + 0.05 | 0.98 + 0.01 |
| 4000 | 5.81 + 0.05 | 0.98 + 0.01 |
| 8000 | 5.80 + 0.08 | 0.97 + 0.01 |

Noise Reduction Coefficient=0.95

The above data indicates that the panel of this invention is highly efficient in sound absorption. By way of comparison, most panels in current use for sound absorption have noise reduction coefficients below 0.85. A wall which is surfaced with a multitude of the panels of this Example has the appearance of a continuous fabric because the frame member is concealed by virture of the manner of construction of the panel.

EXAMPLE 2

The panel of Example 1 was compared with four commercially available sound-absorbing wall panels, employing six criteria of comparison. The evaluations made are reported in the following table of information.

| Panel Type | Noise (NRC) Reduction Coefficient | Impact Resistance | Edge Durability | Fire Retardance | Appearance | Ease of Field Alteration |
|---|---|---|---|---|---|---|
| Panel of Example 1 | Excellent | Excellent | Excellent | Excellent | Excellent | Excellent |
| Bonded Organic Fiber[1] | Poor to Average | Excellent | Good | Poor | Average to Poor | Good |
| Inorganic | Poor | Good | Good | Average to | Excellent | Good |

-continued

| Panel Type | Noise (NRC) Reduction Coefficient | Impact Resistance | Edge Durability | Fire Retardance | Appearance | Ease of Field Alteration |
|---|---|---|---|---|---|---|
| Cement/ Fiber[2] | | | | Excellent | | |
| Fiberglass board | Average | Average | Average | Poor to Average | Excellent | Average to Poor |
| Metal over Fiberglass[3] | Average | Average | Average | Average to Excellent | Average to Poor | Poor |

[1]A product sold by Tectum, Inc. of Newark, OH.
[2]A product sold by the Armstrong Company of Lancaster, PA.
[3]A product sold by the Eckel Industries, Inc. of Cambridge, MA.

As the information of the above table indicates, only the panel product of the present invention was adjudged to possess an excellent rating in the six characteristics that were evaluated.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A panel comprised of:

a) a mat of rockwool bounded by flat front and rear surfaces and four straight perimeter edges disposed in a rectangular array, said mat having a density between 6 and 8 pounds per cubic foot and a thickness between one and two inches, b) front and rear sheets of non-woven interadhered continuous filament fiberglass bonded to said flat front and rear surfaces, respectively, of said rockwool mat, said sheets having interior and exterior surfaces defining a thickness between 20 and 30 mils, and having a weight in the range of 0.75 to 3 ounces/square foot, c) a rigid rectangular frame comprised of four elongated straight sections, each section comprised of paired spaced apart parallel front and rear sidewalls disposed to lie against said flat front and rear surfaces, respectively, of said mat of rockwool, and an end wall disposed orthogonally to said sidewalls as a continuous integral extension thereof and forming with said sidewalls a structure of uniform U-shaped trough-like cross sectional configuration, said end wall disposed to lie against an edge of said rockwool mat, and d) a cloth facing tautly disposed upon the exterior surface of said front sheet of fiberglass and extending around said frame sections and bonded to the rear sidewalls of said sections.

2. The panel of claim 1 wherein the sidewalls of the sections of said frame are disposed to lie between a flat surface of said rockwool mat and the corresponding fiberglass sheet which is bonded to said sidewall.

3. The panel of claim 1 having a compressive resistance between 200 and 300 lbs./ft.$^2$ at 10% compression.

4. The panel of claim 1 which, when tested for sound absorption by way of ASTM C423-90a test, provides a noise reduction coefficient above 0.85.

5. The panel of claim 1 wherein the length of said elongated straight sections is between 2 and 8 feet.

6. The panel of claim 1 wherein means are disposed upon the exterior surface of said rear sheet of fiberglass for attachment of the panel to a wall surface.

* * * * *